United States Patent [19]

Murray

[11] Patent Number: 4,910,540

[45] Date of Patent: Mar. 20, 1990

[54] COUNTERCURRENT ASPHALT DRUM DRYER/MIXER

[75] Inventor: Stuart W. Murray, Oklahoma City, Okla.

[73] Assignee: CMI Corporation, Oklahoma City, Okla.

[21] Appl. No.: 351,864

[22] Filed: May 12, 1989

[51] Int. Cl.[4] ..... B28C 5/46

[52] U.S. Cl. ..... 366/7; 366/23; 366/25

[58] Field of Search ..... 366/4, 7, 22, 23, 24, 366/25, 33, 34, 40, 54, 147; 106/281.1, 273.1, 284, 281 R

[56] References Cited

U.S. PATENT DOCUMENTS

| | | | |
|---|---|---|---|
| Re. 31,904 | 6/1985 | Mendenhall | 366/25 |
| Re. 31,905 | 6/1985 | Mendenhall | 106/281 R |
| 3,614,071 | 10/1971 | Brock | 366/4 |
| 4,074,894 | 2/1978 | Mendenhall | 366/7 |
| 4,215,941 | 8/1980 | Mendenhall | 366/25 |
| 4,787,938 | 11/1988 | Hawkins | 366/25 |

*Primary Examiner*—Robert W. Jenkins

*Attorney, Agent, or Firm*—Dunlap, Codding, Peterson and Lee

[57] ABSTRACT

A drum mixer having a internal combustion gas cylinder extending substantially the length of the drum mixer is provided. Hot combustion gases are generated by a flame within the cylinder. The combustion gases within the cylinder flow in a countercurrent direction the to the flow of material within the drum mixer. The combustion gases exit the cylinder generally at the receiving end of the drum mixer and are directed towards the discharge end thereof in a parallel relation to the flow of material. The horizontal position of the flame within the drum is adjustable and a valve for mixing the gases within the drum adjacent the discharge end thereof with the flame is also provided.

27 Claims, 3 Drawing Sheets

COUNTERCURRENT ASPHALT DRUM DRYER/MIXER

BRIEF SUMMARY OF THE INVENTION

1. Field of Invention

The present invention relates generally to drum mixers used for producing an asphaltic composition.

2. Background of the Invention

In the present state of the art of making hot mix asphalt in a drum mixer type plant wherein a portion of the materials used in making the composition comprises recycle asphalt, there are basically two types of drums; a parallel-flow drum and a counter-flow drum.

A parallel-flow drum is represented by U.S. Pat. Nos. Re: 31,904 and 31,905. In such a parallel-flow drum, the burner is located at the higher, input end of the drum where virgin aggregate is introduced, such that the virgin aggregate flow is parallel with the flow of the hot gases of combustion. Recycle material is introduced at a cooler zone of the drum and flows, along with the hot virgin aggregate, parallel to the flow of the hot gases of combustion, such that the recycle material is heated both by contact with the hot virgin aggregate and the gases of combustion.

A counter-flow drum is represented by U.S. Pat. No. 4,787,938. In this type of drum, the burner is located at an intermediate point in the drum with the hot gases of combustion flowing toward the higher, input end of the drum where the virgin aggregate is introduced. Thus, the virgin aggregate and hot gases of combustion are in a counter-flowing relation. The recycle material is introduced into the drum downstream from the burner. In this type of drum, the recycle material is heated solely, or almost solely, by contact with the hot virgin aggregate. A similar process is carried out in what is known in the art as a double barrel arrangement where the hot virgin aggregate is discharged from the lower end of the rotating drum outwardly into a housing surrounding a portion of the drum, and the recycle material is introduced into the housing around the rotating drum for mixture with the hot virgin aggregate. Here again, the recycle material is heated almost solely by the hot virgin aggregate.

In the present invention a countercurrent stream of hot gases travels substantially the length of the drum within a cylinder such that the countercurrent stream of hot gases is shielded from substantial contact with the materials in the drum. The hot gases flowing in through the cylinder transfer heat through the walls of the cylinder. The countercurrent stream of hot gases exits the cylinder adjacent the receiving end of the drum and is directed towards the discharge end of the drum in a parallel relation to the flow of materials in the drum.

Virgin aggregate material is introduced at the receiving end of the drum and is heated by the flow of hot gases exiting the cylinder and by contact with the heated cylinder. The recycle material is introduced at an intermediate location in the drum and is mixed with the hot virgin aggregate. The recycle material is heated by contact with the hot virgin aggregate and the heated cylinder, and by exposure to the parallel flow of the hot gases.

DESCRIPTION OF THE PREFERRED EMBODIMENT

Figure 1:
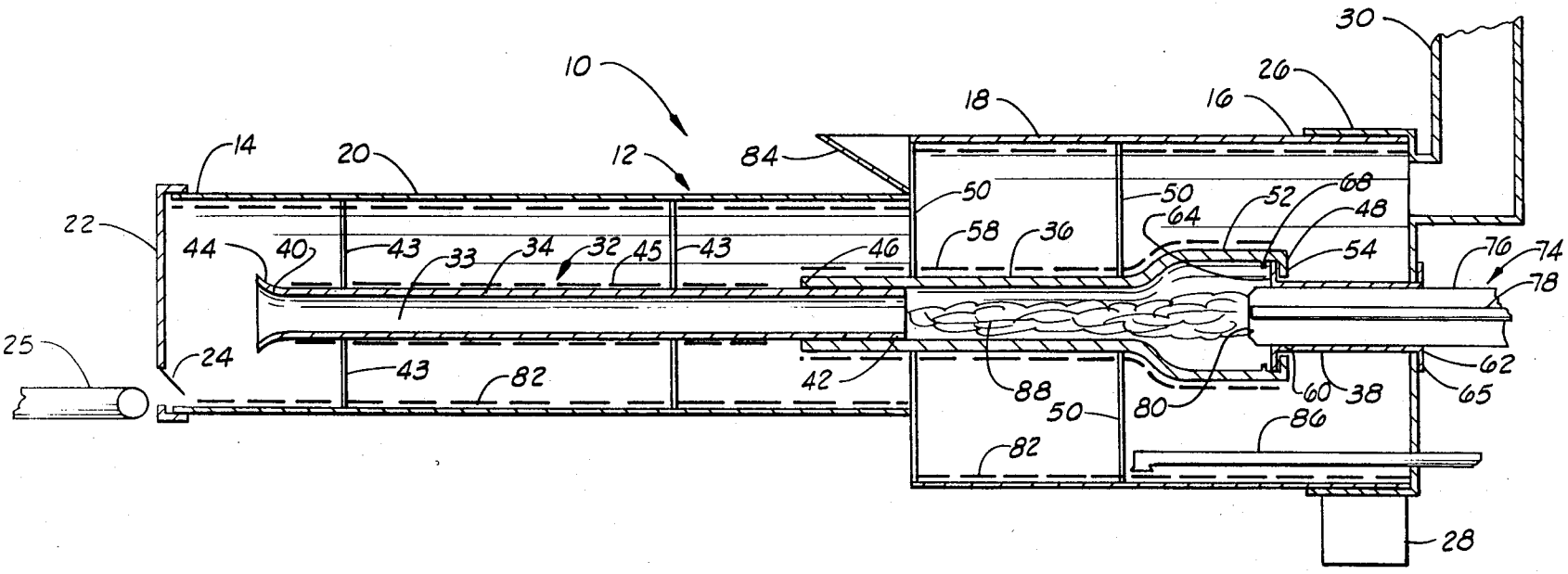
FIG. 1 is a schematic, vertical cross-sectional view of a drum mixer constructed in accordance with this invention.

As shown in FIG. 1, the present invention comprises a drum mixer designated generally by the reference numeral 10. The drum mixer 10 includes a drum 12 having a first end 14 and a second end 16. It will be understood that the drum 12 is positioned in a slightly inclined position wherein the level of the first end 14 is above the level of the second end 16. It will be further understood that the drum 12 may be rotated in this position by conventional drive means.

The drum 12 is further characterized by having an expanded portion 18 extending from the second end 16 and a smaller diameter portion 20 extending from the first end 14. The portion 18 functions as what will be called the mixing zone within the drum mixer 10 and the portion 20 functions as what will be called the drying zone within the drum mixer 10

A first, cylindrically shaped, stationary collar 22 is positioned at the first end 14 of the drum 10. Portions of the collar 22 overlie the first end 14 of the drum 10 such that the first end 14 may freely rotate within the collar 22.

The collar 22 further includes a receiving gate 24. The gate 24 permits the introduction of a first volume of material (not shown) into the first end 14 of the drum 12. The first volume of material may be transported to the gate 24 by a conveyor 25.

A second, cylindrically shaped, stationary collar 26 is positioned at the second end 16 of the drum 10. Portions of the collar 26 overlie the second end 16 of the drum 10 such that the second end 16 may freely rotate within the collar 26. The collar 26 includes a discharge structure 28 and an exhaust duct 30. The duct 30 is connected to an exhaust collection system (not shown).

The drum mixer 10 further includes a cylinder 32 having a continuous passage 33 therethrough. The cylinder 32 is substantially horizontally positioned within the drum 12 and supported along the center horizontal axis of the drum 12 such that the cylinder 32 rotates when the drum 12 is rotated. The cylinder 32 includes a stationary section 34, a first telescoping section 36 and a second telescoping section 38.

Figure 4:
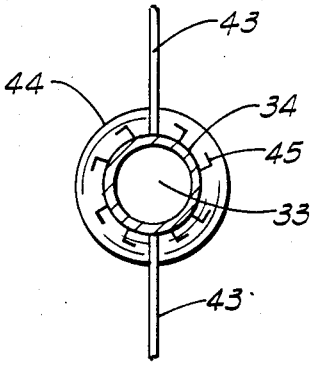
FIG. 4 is a cross-sectional view taken along lines 4—4 of FIG. 2.

The stationary section 34 has an open first end 40 and an open second end 42. The section 34 is secured to a plurality of equal length struts 43. The outer end of each strut 43 is secured, as by welding, to the interior wall of the smaller diameter portion 20 of the drum 12 and the inner end of each strut 43 is secured, as by welding, to the exterior surface of section 34. In this way, the section 34 is oriented along the center axis of the drum 12 such that the first end 40 is adjacent the first end 14 of the drum 12 and the second end 42 is positioned substantially at the interface between the portions 18 and 20 of the drum 12. The section 34 is further characterized as having an outwardly flared portion 44 at the first end 40, and a plurality of material flights 45 secured to the outer surface thereof (FIG. 4).

Figure 5:
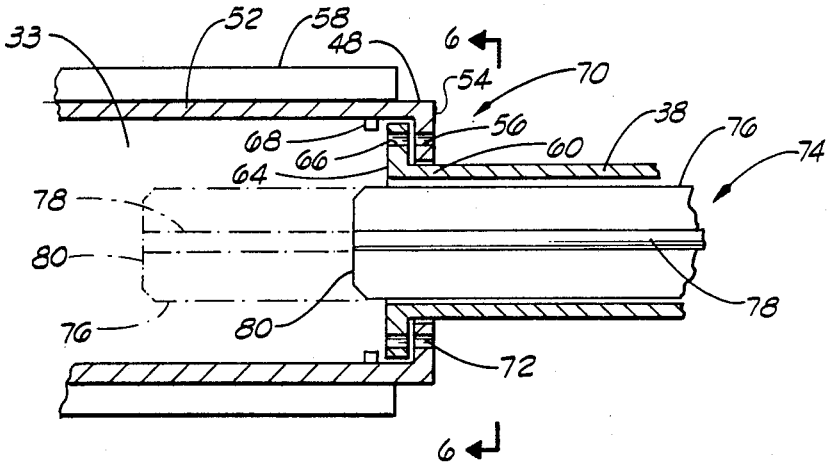
FIG. 5 is an enlarged fragmented cross-sectional view of some internal structures of the drum mixer.
Figure 6:
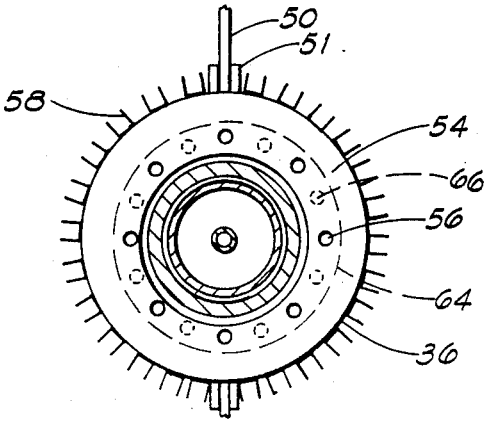
FIG. 6 is a cross—sectional view taken along lines 6—6 of FIG. 5.

The first telescoping section 36 has an open first end 46 and an open second end 48. The second 36 is slidably secured to a plurality of equal length struts 50. The outer end of each strut 50 is secured, as by welding, to the internal surface of the expanded portion 18 of the drum 12. The inner end of each strut 50 is slidably positioned in a channel 51 (FIGS. 5 and 6). The channel 51 is secured, as by welding, to the external surface of section 36. In this way, the section 36 is movable along the center axis of drum 12.

The section 36 is sized such that portions of the section 36 adjacent the first end 46 telescopes over and slidingly engage portions of the section 34 adjacent the second end 42. The section 36 is further characterized as having an expanded portion 52 extending from the second end 48. The expanded portion 52 functions as what will be referred to as the combustion zone within the drum 12.

Figure 3:
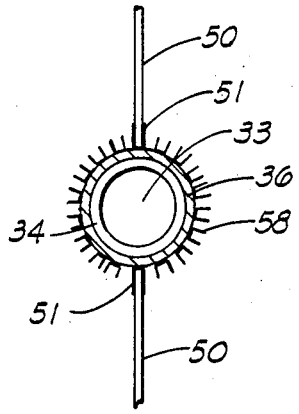
FIG. 3 is a cross-sectional view taken along lines 3—3 of FIG. 2.

An annular, inwardly extending flange 54 is secured, as by welding, to the second end 48 of the section 36. As shown in FIGS. 5 and 6, and discussed in greater detail below, the flange 54 has a plurality of horizontal apertures 56 therethrough. A plurality of material flights 58 are secured to the exterior surface of section 36 (FIG. 3).

The section 38 has an open first end 60 and an open second end 62. The section 38 is secured in the collar 26 for both lateral and rotational movement therein. As most clearly shown in FIG. 5, the first end 60 is sized such that a portion of the section 38, extends into the second end 48 of the section 36 through the flange 54.

The first end 60 and the second end 62 each have an annular, outwardly extending flange 64 and 65, respectively, secured thereto. As shown in FIGS. 5 and 6 the flange 64 has a plurality of apertures 66 therethrough, said apertures 66 being alignable with apertures 56 of the flange 54. The flange 64 is maintained is close clearance with flange 54 by a plurality of stops 68 secured to the interior surface of section 36 adjacent the second end 48.

The flange 54 and 64 form what may be called a valve 70. The valve 70 is operated by turning the section 38 between an open position (FIG. 5), and a closed position (FIG. 6).

In the open position, the section 38 is rotated until the apertures 66 are aligned with the apertures 56 of the flange 54. In this position, a plurality of passageways 72 are formed between the passage 33 of the cylinder 32 and the interior of the drum 12 at the second end 16 thereof. The passageways 72 permit gases within the expanded portion 18 to enter the combustion zone (expanded portion 52) of the section 36. To transition from the open position to the closed position, the section 38 is turned as by griping and turning the flange 65, until the apertures 56 completely overlie solid portions of the flange 64. It will be understood that the passageways 72 may be selectively eclipsed by turning section 38 until the desired overlap of the apertures 56 and 66 is achieved.

Figure 2:
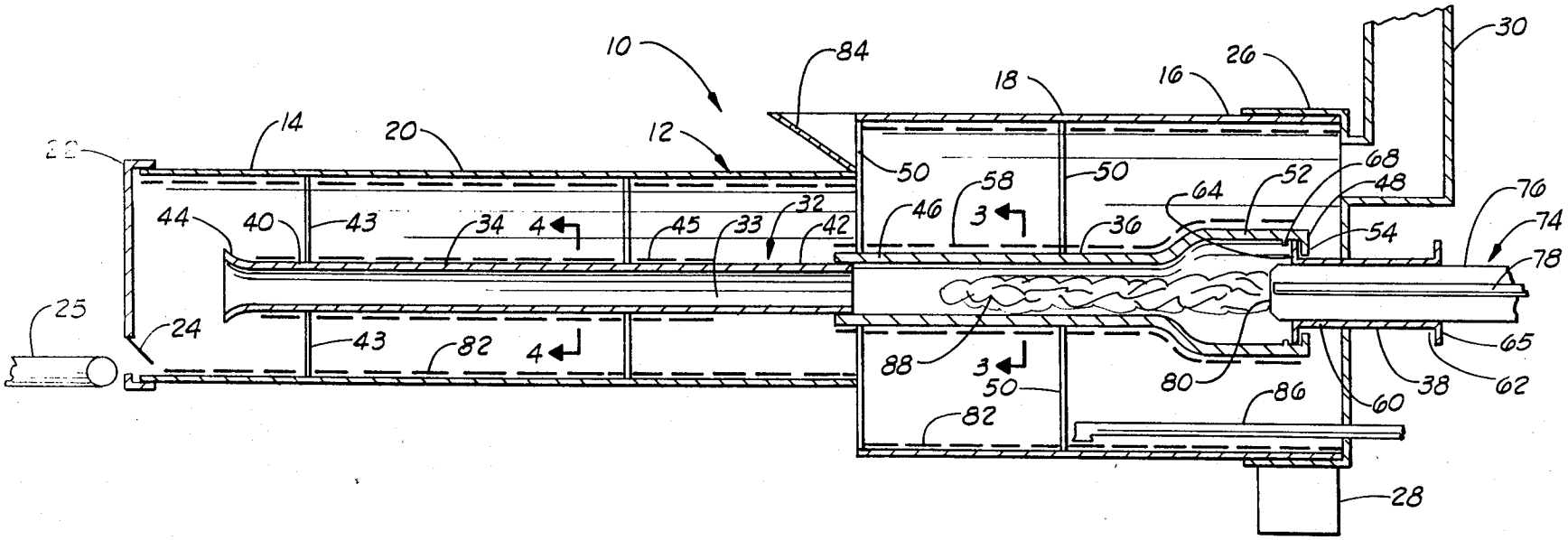
FIG. 2 is the view of FIG. 1 illustrating lateral movement of some internal structures.

As shown in FIGS. 1 and 2, a burner assembly 74 is positioned at the second end 16 of the drum 12. The burner assembly 74 includes a tube 76, a fuel line 78 extending substantially the length of the tube 76 and a burner head 80 extending into the combustion zone.

As shown in FIG. 5, the tube 76 is slidably secured within the section 38 such that the horizontal position of the burner head 80 may be varied within the drum 12. It will be further appreciated that, as shown in FIGS. 1 and 2, the horizontal position of the burner head 80 may also be varied within the drum 12 by securing the tube 76 within the section 38 and laterally varying the length of the section 38 extending beyond the collar 26.

The drums mixer 10 further includes a plurality of material flights 82 secured along the length of the drum 12. A material entry structure 84 is positioned at the interface between the drying zone (portion 20) and the mixing zone (portion 18) of the drum 12, for introducing a second volume of material. A liquid asphalt line 86 is secured to the collar 26 and extends into the mixing zone.

In accordance with the present invention, the method for continuously producing an asphaltic composition preferably is carried out by rotating drum 12 and introducing a first volume of material (virgin aggregate), into the first end 14 of the drum 12 through the receiving gate 24. As the first volume of material flows from the first end 14 of the drum 12 towards the second end 16 of the drum 12 it is lifted by the flights 82 thus creating curtains of falling material.

The first volume of material is heated within the drum mixer 10 by creating a flame 88 within the combustion zone (portion 52) at the burner head 80 of the burner assembly 74. It will now be apreciated that gases entering the combustion zone through the openings 72 as described above, are mixed with the flame 88. In this way, by-products of incomplete burner fuel combustion and/or hydrocarbon vapors may be converted into non-pollutants.

The hot gases produced by the flame 88 are confined within the cylinder 32 and are directed towards the first end 14 of the drum 12 in a countercurrent relation to the flow of the first volume of material. The countercurrent flow of hot gases exits the cylinder 32 at the first end 40. In this way, the hot gases flowing in a countercurrent direction within the cylinder 32 transfer heat through the walls of th cylinder 32 to the first volume of material.

It will be understood that for a relatively short distance within the drum 12, some of the countercurrent gases exiting the first end 40 of the cylinder 32 contact the first volume of material traveling in the drum 12. This contact occurs between the first end 14 of the drum 12 and the first end 40 of the cylinder. Thus, it may be said that the cylinder 32 shields the countercurrent stream of hot gases from substantial contact with the first volume of material.

The direction of the countercurrent stream of hot gases is reversed at the first end 14 of the drum 12 by the collar 22. In this way, the hot gases produced by the flame 88 are directed from the first end 14 to the second end 16 of the drum 12 in a parallel relation to the flow of the first volume of material. The first volume of material is thus heated within the drum mixer 10 by the flow of countercurrent gases exiting the cylinder 32 and the flow of parallel gases. Additionally, the first volume of material is heated by contacting the heated external surfaces of the cylinder 32 and the material flights 45.

A second volume of material (recycle material), is introduced into the drum mixer 10 through the material entry structure 84. Alternatively, the second volume of material may be virgin aggregate material. The second volume of material flows from the material entry structure 84 towards the second end 16 of the drum 12.

The second volume of material is mixed with the first volume of material in the mixing zone (expanded portion 18). As the first and second volumes of material flow towards the second end 16 of the drum 12, the materials are lifted by the flights 82 such that curtains of falling materials are created therein.

There will be some transfer of heat by conduction from the hot first volume of material to the cooler second volume of material entering the drum through the material entry structure 84. In addition, the first and second volumes of materials are heated within the expanded portion 18 by the parallel flow of hot gases therein and by contacting the heated external surfaces of the cylinder 32 and the material flights 58.

It is understood that, depending upon the composition of the second volume of material, a certain quantity of liquid asphalt sufficient to produce an asphaltic composition is injected through the line 86 and into the mixing zone. The liquid asphalt is mixed with the first and second volumes of materials to produce the desired asphaltic composition. The asphaltic composition is discharged from the second end 16 of the drum 12 through the discharge structure 28. It will be understood that continuous quantities of the first and second volumes of material are introduced into the drum mixer 10 such that a continuous discharge of asphaltic composition is produced.

A portion of the hot gases in the expanded portion 18 of the drum 12 are exhausted through the duct 30 to suitable pollution control equipment (not shown). A portion of the gases may also be directed through the valve 70 into the flame 88 for burning of the combustible components as previously described.

Changes may be made in the construction, operation, and arrangement to the various parts, elements, steps, and procedures described herein without departing from the spirit and scope of the invention as defined in the following claims.

I claim:

1. In a method for continuously producing an asphaltic composition comprsing the steps of:

introducing a first volume of material into an inclined, rotating drum at a first end to flow generally from the first end to a second end of the drum;

generating a flame within the drum between the first end and the second end thereof, wherein a countercurrent stream of hot gases is generated by the flame;

shielding the countercurrent stream of hot gases from substantial contact with the first volume of material;

reversing the flow of the countercurrent stream of hot gases at the first end of the drum such that a parallel stream of hot gases is generated, wherein the parallel stream of hot gases flows from the first end of the drum towards the second end of the drum, and wherein the first volume of material is exposed to the parallel stream of hot gases;

introducing a second volume of material into the drum between the first end of the drum and the second end of the drum to flow generally towards the second end of the drum;

shielding the second volume of material from the flame;

mixing the first volume of material with the second volume of material between the first end of the drum and the second end of the drum; and discharging the asphaltic composition from the second end of the drum.

2. The method of claim 1 including the step of varying the position of the flame within the drum.

3. The method of claim 1 including the step of selectively mixing the stream of hot gases at the second end of the drum with the flame.

4. The method of claim 1 including the step of mixing liquid asphalt with the mixing first and second volumes of materials to produce the asphaltic composition.

5. The method of claim 1 wherein the first volume of material is virgin aggregate material and the second volume of material is recycle asphalt material.

6. The method of claim 1 wherein the first volume of material is virgin aggregate material and the second volume of material is virgin aggregate material.

7. An apparatus for producing an asphaltic composition comprising a rotatable drum having a first end and a second end;

means for introducing a first volume of material into the rotatable drum at the first end thereof, wherein the first volume of material flows generally towards the second end of the drum;

means for generating a flame within the rotatable drum between the first end and the second end thereof, wherein a countercurrent stream of hot gases is generated by the flame, and wherein the countercurrent stream of hot gases is directed towards the first end of the rotatable drum;

means for shielding the countercurrent stream of hot gases from contact with the first volume of material;

means for reversing the flow of the countercurrent stream of hot gases at the first end of the drum such that a parallel stream of hot gases is generated, wherein the parallel stream of hot gases flows from the first end of the rotatable drum towards the second end of the rotatable drum, and wherein the first volume of material is exposed to the parallel stream of hot gases;

means for introducing a second volume of material into the rotatable drum between the first and second ends thereof to flow generally towards the second end of the rotatable drum;

means for shielding the second volume of material from the flame;

means for mixing the first volume of material with the second volume of material between the first end of the rotatable drum and the second end of the rotatable drum; and means for discharging the mixture of the first volume of material and second volume of material at the second end of the rotatable drum.

8. The apparatus of claim 7 further comprising means for introducing liquid asphalt into the mixing first and second materials.

9. The apparatus of claim 7 further comprising means for varying the position of the flame within the drum.

10. The apparatus of claim 9 wherein the means for varying the position of the flame within the drum includes a burner assembly having a burner head slidably secured within the drum.

11. The apparatus of claim 7 further comprising means for selectively mixing the parallel stream of hot gases at the second end of the rotatable drum with the flame.

12. The apparatus of claim 11 wherein the means for selectively mixing the parallel steram of hot gases at the second end of the rotatable drum with the flame includes a valve formed between the flame and the second end of the drum to selectively direct a portion of the parallel stream of hot gases adjacent the valve into the flame, and, alternately, preventing the parallel stream of hot gases from contacting the flame.

13. The apparatus of claim 7 wherein: the means for shielding the countercurrent stream of hot gases and shielding the second volume of material from the flame includes a cylinder having a first end and a second end; the cylinder is secured within the rotatable drum, the cylinder is sized such that first end thereof is adjacent the first end of the rotatable drum and the second end extends beyond the second end of the rotatable drum, and the flame is enclosed within the cylinder.

14. The apparatus of claim 13 further comprising means for varying the position of the flame within the drum.

15. The apparatus of claim 14 wherein the means for varying the position of the flame within the drum includes a burner assembly having a burner head slidably secured within the drum.

16. The apparatus of claim 13 further comprising means for selectively mixing the parallel stream of hot gases at the second end of the rotatable drum with the flame.

17. The apparatus of claim 16 wherein the means for selectively mixing the parallel stream of hot gases at the second end of the rotatable drum with the flame includes a valve, formed within the cylinder between the flame and the second end of the drum, to selectively direct a portion of the parallel stream of hot gases adjacent the valve into the cylinder, and, alternately, preventing the parallel stream of hot gases from entering the cylinder.

18. The apparatus of claim 7 where the means for shielding the countercurrent stream of hot gases and the means for shielding the second volume of material from the flame includes a cylinder, having a stationary section, and a first telescoping section, and wherein the stationary section, having a first end and a second end is secured within the rotatable drum such that the first end of the stationary section is adjacent the first end of the rotatable drum and the second end of the stationary section is secured between the first end of the rotatable drum and the second end of the rotatable drum, and wherein the first telescoping section, having a first end and a second end is slidably secured within the rotatable drum, and wherein the first end of the first telescoping section telescopes over and slidingly engages a portion of the stationary section adjacent the second end of the stationary section.

19. The apparatus of claim 18 further comprising means for varying the position of the flame within the drum.

20. The apparatus of claim 19 wherein the means for varying the position of the flame within the cylinder includes a burner assembly having a burner head extending into the first telescoping section, and wherein a portion of the burner assembly adjacent the burner head is slidably secured within the first telescoping section such that lengthwise movement of the portion of the burner assembly adjacent the burner head within the first telescoping section changes the position of the burner head within the rotatable drum.

21. The apparatus of claim 18 further comprising means for selectively mixing the parallel stream of hot gases at the second end of the rotatable drum with the flame.

22. The apparatus of claim 21 wherein the means for selectively mixing the parallel stream of the gases at the second end of the rotatable drum with the flame includes a valve, formed in the first telescoping section adjacent the second end thereof, to selectively direct a portion of the parallel stream of hot gases adjacent the valve into the first telescoping section, and, alternately, preventing the parallel stream of hot gases from entering the first telescoping section.

23. The apparatus of claim 18 further comprising a second telescoping section, having a first end and a second end, wherein the second telescoping section is slidably secured at the second end of the rotatable drum, and wherein the first end of the second telescoping section is secured to the second end of the first telescoping section, and wherein the second end of the second telescoping section extends beyond the second end of the rotatable drum, and wherein the flame is enclosed generally within the first telescoping section.

24. The apparatus of claim 23 further comprising means for varying the position of the flame within the drum.

25. The apparatus of claim 24 wherein the means for varying the position of the flame within the cylinder includes a burner assembly having a burner head extending into the first telescoping section, and wherein a portion of the burner assembly adjacent the burner head is secured to the second telescoping section such that lengthwise movement of the second telescoping section changes the position of the burner head within the rotatable drum.

26. The apparatus of claim 23 further comprising means for selectively mixing the parallel stream of hot gases at the second end of the rotatable drum with the flame.

27. The apparatus of claim 26 wherein the means for selectively mixing the parallel stream of hot gases at the second end of the drum with the flame includes a valve located at the interface between the first telescoping section and the second telescoping section to selectively direct a portion of the parallel stream of hot gases adjacent said interface into the first telescoping section, and, alternately, preventing the parallel stream of hot gases from entering the first telescoping section.

* * * * *